US006171656B1

(12) United States Patent
Settles

(10) Patent No.: US 6,171,656 B1
(45) Date of Patent: Jan. 9, 2001

(54) METHOD AND APPARATUS FOR COLLECTING OVERSPRAY

(75) Inventor: Gary S. Settles, Bellefonte, PA (US)

(73) Assignee: The Penn State Research Foundation, University Park, PA (US)

( * ) Notice: Under 35 U.S.C. 154(b), the term of this patent shall be extended for 0 days.

(21) Appl. No.: 09/165,482

(22) Filed: Oct. 2, 1998

Related U.S. Application Data

(60) Provisional application No. 60/061,068, filed on Oct. 3, 1997.

(51) Int. Cl.[7] ..... B05D 1/02; B05B 1/28

(52) U.S. Cl. ..... 427/421; 118/326; 239/120; 454/50

(58) Field of Search ..... 427/421; 118/326, 118/DIG. 7; 454/50; 239/120, 124

(56) References Cited

U.S. PATENT DOCUMENTS

| | | | | |
|---|---|---|---|---|
| 3,842,798 | * | 10/1974 | Gerlovich | 118/326 |
| 3,861,594 | * | 1/1975 | Wendling | 239/1 |
| 4,069,974 | * | 1/1978 | Zawacki | 239/115 |
| 4,643,082 | * | 2/1987 | Lynham et al. | 98/115.2 |
| 5,352,257 | | 10/1994 | Powers . | |
| 5,360,165 | * | 11/1994 | Singhal | 239/122 |
| 5,393,345 | | 2/1995 | Smith . | |
| 5,489,234 | | 2/1996 | Hockett . | |
| 5,536,315 | | 7/1996 | Guzowski et al. . | |
| 5,688,323 | * | 11/1997 | Kane et al. | 118/326 |

OTHER PUBLICATIONS

Kwok, K.C,., "How Atomization Affects Transfer Efficiency," Industrial Finishing, pp. 28, 30, 32, (May 24, 1992).

Hicks, P.G., "Simulation of Paint Transfer in an Air Spray Process," Fluid Mechanics and Heat Transfer in Sprays, ASME, pp. 145–154, (Dec. 24, 1993).

Settles, G.S., "A Flow Visualization Study of Airless Spray Painting," Proceedings of 10th Ann. Conf. on liquid Atomization and Spray Syst., ILASS–Americans'97 (Canada), pp. 145–149, (May 18, 1997).

(List continued on next page.)

*Primary Examiner*—Diana Dudash
*Assistant Examiner*—Jennifer Calcagni
(74) *Attorney, Agent, or Firm*—Thomas J. Monahan

(57) ABSTRACT

The present invention is an overspray collector and method of collecting overspray. The overspray collector provides a device and method to intercept overspray produced by spraying coating material onto any relatively-flat surface and preventing air pollution by capturing such pollution at its source. The overspray collector includes a shroud which surrounds and moves with the spraying device(s), while maintaining a gap between itself and the work surface being sprayed. Behind the spraying device and opposite the work surface, the shroud terminates in ducting through which overspray-laden air exits. Air inlet slots allow atmospheric air to enter in sufficient quantity to minimize residual airflow through the aforementioned gap. Internal to the shroud, the spray from the spray device(s) impinges upon the work surface and the finest sprayed particles turn laterally along the work surface without depositing thereupon, thus forming overspray. This lateral overspray stream is intercepted by the shroud and forced to separate from the work surface. The overspray is then directed to the ducting by the shape of the shroud. Once collected, the overspray can be filtered or otherwise removed from the collected airstream. In aerodynamic terms, the overspray collector functions by the generation of an approximately-two-dimensional flowfield dominated by twin columnar vortices, and by the separation of the overspray-laden wall jet flow by way of an imposed adverse pressure gradient. In contrast to spray-booth-type overspray treatments of the prior art the present invention is small and light enough to be able to move with the spraying device and can be moved by way of a manually- or robotically-controlled traversing arm.

25 Claims, 8 Drawing Sheets

OTHER PUBLICATIONS

Settles, G.S., "An Overflow of Planar Laser Scattering for the Visualization of High–Speed Airflows," Flow Visualization VI, Springer–Verlag, pp. 628–633, (Dec. 24, 1992).

Lefebvre, A.H., "Atomization and Sprays," Hemisphere Pub. Corp. (NY), pp. 59–78, (Dec. 24, 1989).

Dexter, R.W., "Measurement of Extensional Viscosity of Ploymer Solutions and its Effects on Atomization from a Spray Nozzle," Atomizationa and Sprays, Begell House, Inc, pp. 167–191, (Dec. 24, 1996).

Mansour, A., "Air–blast Atomization of Non–Newtonian Liquids," Jornal of Non–Newtonian fluid Mechanics, Elsevier, pp. 161–194, (Dec. 24, 1995).

Viscoelastic Breakup in a High Velocity Airstream, "Matta, J.E.," J. of Applied Polymer Science, John Wiley & Sons, pp. 397–405, (Dec. 24, 1982).

Macgregor, S.A., "Air Entrainment in Spray Jets," Int. J. Heat and Fluid Flow, 3rd ed., Butterworth–Heinermann, vol. 12 (No. 3), pp. 279–283, (Sep. 24, 1991).

Wen, F., "Particle Dispersion By Vortex Structures in Plane Mixing Layers," J. of Fluids Engineering, pp. 657–666, (Dec. 24, 1992).

Glauert, M.B., "The Wall Jet," J. of Fluid Mechanics, pp. 625–643, (Dec. 24, 1956).

Daws, L.F., "Movement of Airstreams Indoors," J. Inst. Heating & Ventilation Engrs., pp. 241–253, (Dec. 24, 1970).

* cited by examiner

METHOD AND APPARATUS FOR COLLECTING OVERSPRAY

This application claims priority to U.S. Provisional Application No. 60/061,068 filed Oct. 3, 1997, which is herein incorporated by reference.

GOVERNMENT SPONSORSHIP

This invention was made with governmental support under Grant No. M67004-96-D-001-0004 awarded by the Department of the Navy. The Government has certain rights in the invention.

BACKGROUND

Millions of gallons of paint are sprayed every year worldwide, thereby generating airborne pollution from the paint overspray. Outdoor spray painting of large structures (e.g. bridges, water towers, railroad cars, buildings, and ships) faces stringent discharge regulations limiting the emission of airborne pollutants. Failure to meet such discharge regulations can lead to notices of violation, fines, negative publicity, increased operating costs and delays in work completion. Also, overspray from spray painting often contains toxic particulates and volatile organic compounds which are very difficult to prevent from dispersing into the atmosphere.

In fluid dynamic terms, the three categories of spray painting are airblast atomization, pressure atomization, or some combination of the two. The first category is termed "conventional airspray" in the industry, while the second is known as "airless" paint spraying. Hybrid approaches make up the third category. Transfer efficiency for spray painting is known as the percentage of the total paint sprayed which eventually adheres to the work surface. The paint which does not adhere to the work surface and escapes to the environment is the overspray. Conventional airspray has a transfer efficiency typically in the range of only 20–30%, which has become environmentally unacceptable. Airless spray, on the other hand, has a transfer efficiency often above 50% or better, but with considerable room for improvement. Professional spray-painting equipment is classified by the method of paint atomization (e.g. airspray, airless, air-assisted airless, etc.). In essentially all cases, the spray from a spray gun is shaped in the form of an elongated spray ellipse or "fan" to ease the application of a uniform coating. Whether hand-held or manipulated robotically, the spray gun is traversed in the direction of the short axis of this ellipse, while held perpendicular to the work surface at a fixed spraying distance usually of about twelve (12) inches.

Current industrial spray painting practice involves the use of large temporary containment enclosures to prevent the escape of overspray. These temporary containment enclosures are usually clumsy and ineffective, as they take a brute-force approach rather than invoking aerodynamics of the process to capture the overspray near its source. Such containment enclosures are also labor-intensive to use, have questionable effectiveness and are very costly. No real solution has been presented for painting large outdoor structures or objects. Most of the prior art deals with overspray during the coating of small to moderate-sized indoor objects which are enclosed in a spray booth. An improved technical solution to the problem of spray painting large outdoor objects or structures is seriously needed to meet today's overspray containment standards.

An object of the present invention is to provide an apparatus and method to manage and capture overspray from a spraying device during coating operations of a surface.

Another object of the present invention is to provide an apparatus and method for capturing overspray while coating large outdoor surfaces and structures.

Another object of the present invention is to provide an apparatus for capturing overspray, whereby the apparatus moves with the spraying device during the coating process.

SUMMARY OF THE INVENTION

The present invention is an overspray collector for collecting overspray. The overspray collector includes a shroud, at least one spray device enclosed by the shroud, at least one overspray removal outlet for removing the overspray and at least one air inlet slot for allowing inlet air to enter the shroud and balance the removal of air associated with the removal of the overspray. The shroud includes a back, two sides, and two end caps. The shroud also includes at least one baffle between the air inlet slots and the overspray removal outlets, for separation of the inlet air from the overspray stream being removed. The overspray collector also includes a suction device and ducting leading from the overspray removal outlets to the suction device for inducing the overspray stream from the shroud.

The present invention is also a method of collecting overspray when spraying a coating of spray onto a work surface from at least one spray device mounted within a shroud. The air within the shroud 14 is entrained into the spray to produce a co-flowing stream directed towards the work surface. The co-flowing stream impinges on the work surface, wherein larger particles of the spray are applied to the work surface and finer particles of the spray remain with the co-flowing stream to form an overspray stream which turns and flows laterally along the work surface. The overspray stream is intercepted with the shroud which forces the overspray stream to separate from the work surface due to an imposed adverse pressure gradient. The intercepted overspray stream is directed to at least one outlet of the shroud for removal of the overspray stream from the shroud. Whereby, a suction force is applied to the outlets to induce the overspray stream through the outlets and out of the shroud.

DETAILED DESCRIPTION

Figure 1:
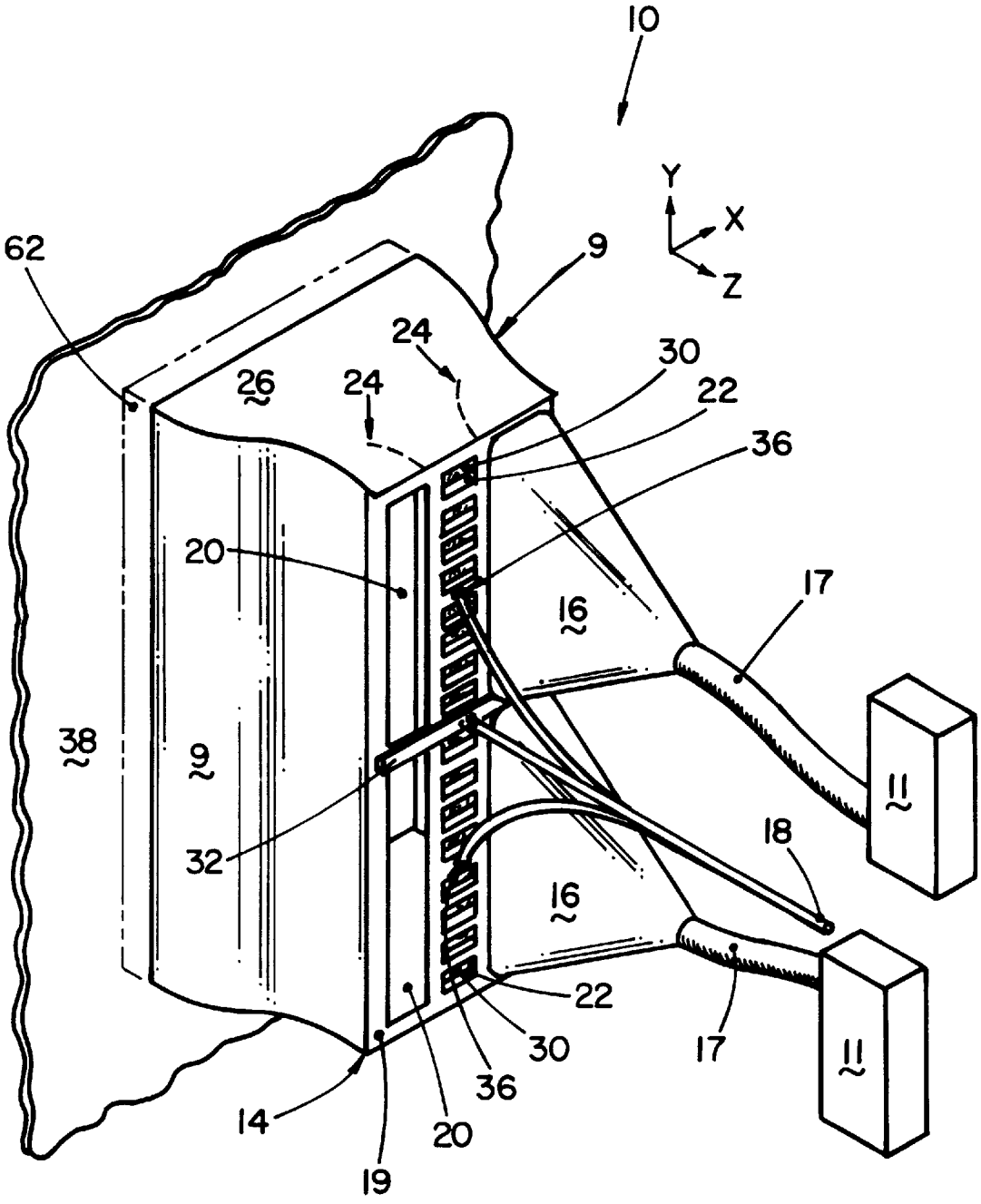
FIG. 1 is a rear perspective view of the overspray collector according to the present invention.
Figure 2:
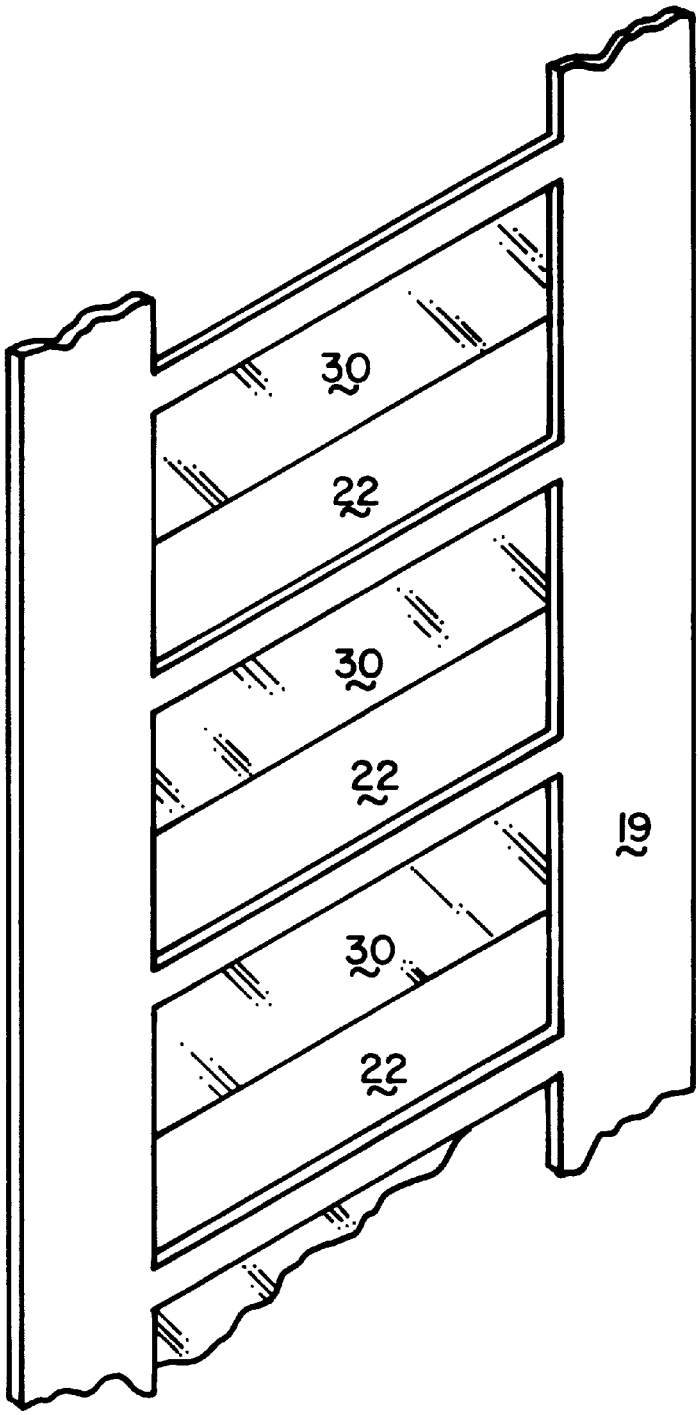
FIG. 2 is a cutaway perspective view of air inlet slots according to the present invention.
Figure 3:
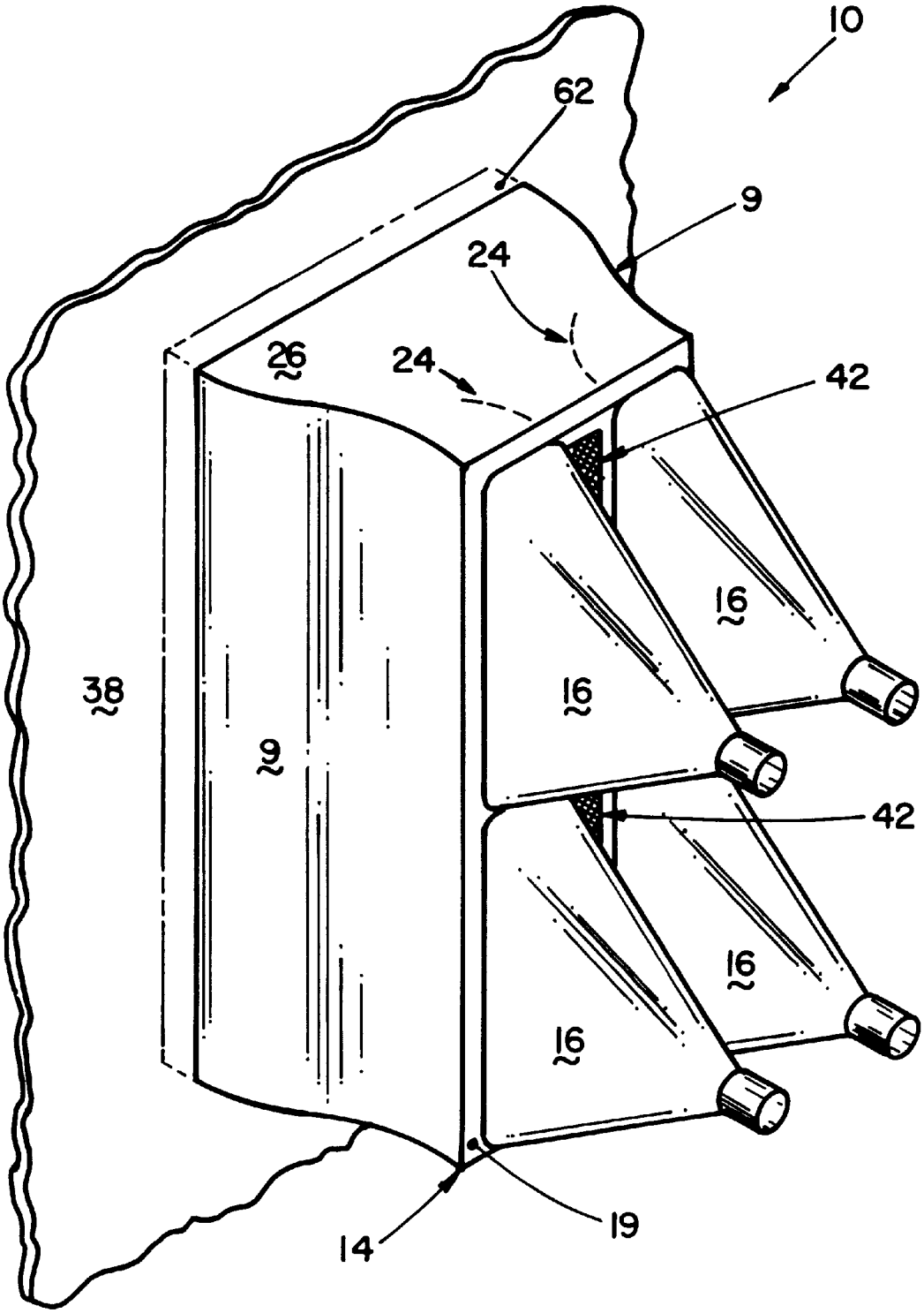
FIG. 3 is a rear perspective view of the overspray collector according to the present invention.
Figure 4:
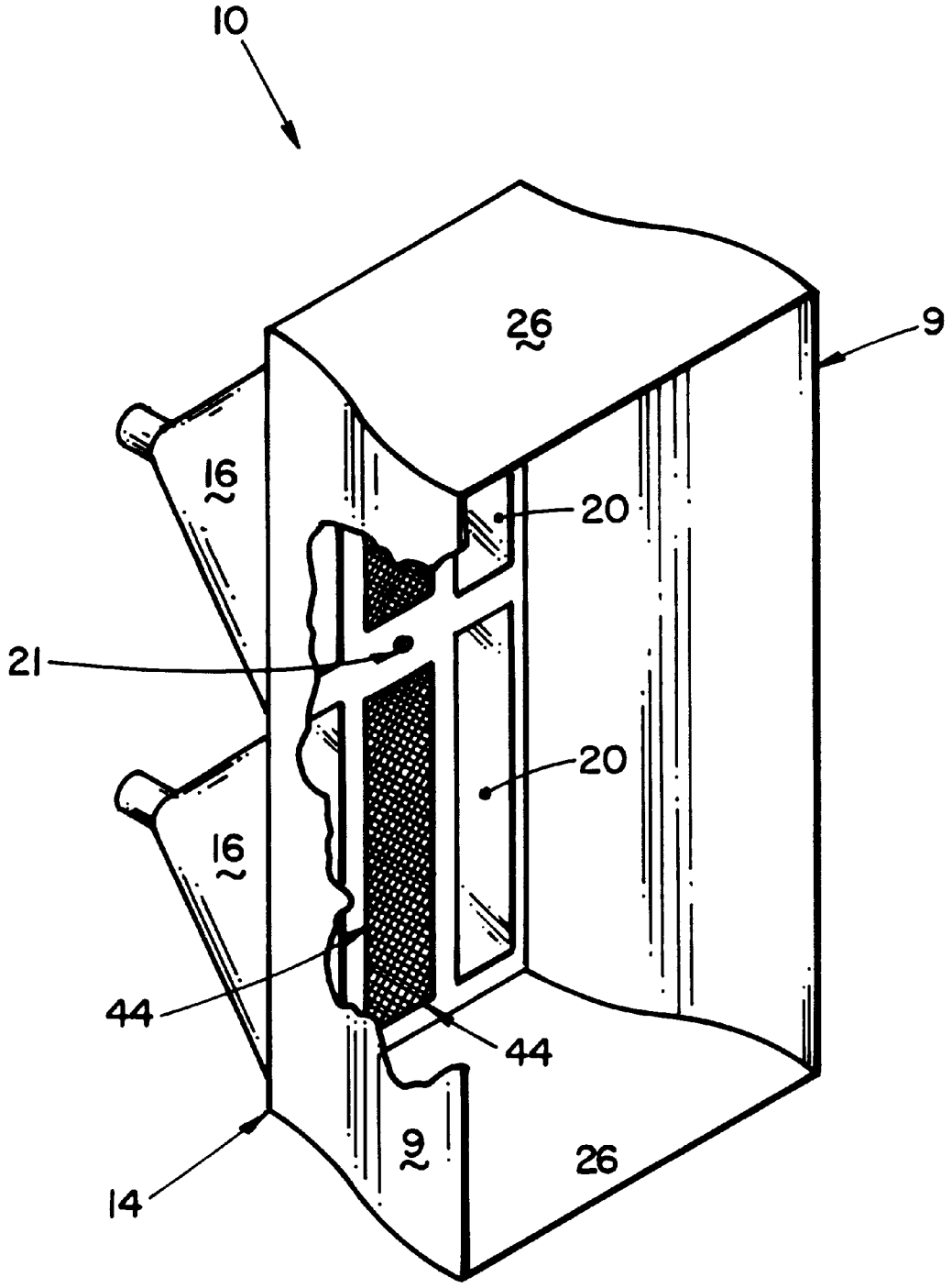
FIG. 4 is a front perspective view of the overspray collector according to the present invention.
Figure 5:
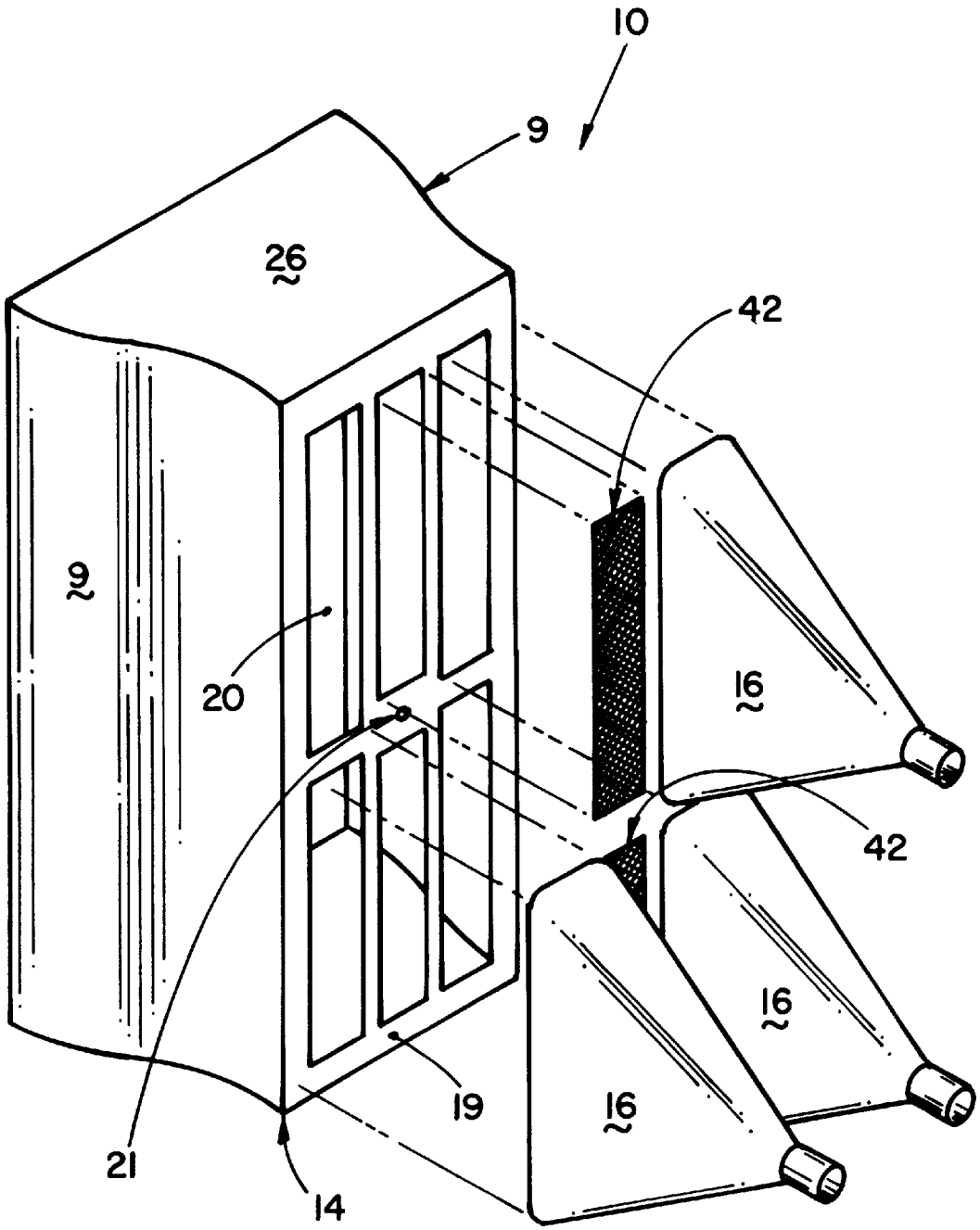
FIG. 5 is a rear exploded view of the overspray collector according to the present invention.

The present invention is an overspray collector 10 for collecting excess coating material or overspray from the atmosphere during outdoor or large-scale surface coating operations. The overspray collector 10 intercepts an overspray stream 12 produced when spraying a coating material onto any relatively-flat surface, thus preventing air pollution by capturing the overspray stream 12 near its source. The overspray collector 10 includes a shroud 14, spray device 36, suction manifolds 16, overspray removal hose/ducting 17, suction device 11 and an actuating arm 18, as shown in FIGS. 1–5 and 8. The shroud 14 includes overspray removal outlets 20, air inlet slots 22, internal baffles 24, end caps 26, adjustable dampers 30 and a structural support 32. FIG. 1 shows the left hand manifolds 16 and hose/ducting 17 removed for clarity. FIG. 5 shows the upper left hand manifold 16 removed for clarity. One or more spray devices 36 are attached to the shroud 14. The spray device 36 supplies the coating to be applied to the surface to be coated within the shroud 14. The surface to be coated henceforth will be referred to as the work surface 38. Spray devices 36 include spray guns for spray painting. As shown in FIG. 1, use of two spraying devices 36 mounted to the shroud 14 allows the coating of roughly twice the area as opposed to using one spraying device 36. FIGS. 3–5 show a shroud 14 that receives only one spraying device 36 in the center, which would be attached through hole 21 of the shroud 14. The suction device 11 is any known device in the art for inducing a suction force via the manifolds 16 and hose/ducting 17.

The shroud 14 includes two sides 9 and a back 19. The sides 9 have a bell-shaped contour. The air inlet slots 22 and overspray removal outlets are part of the back 19 of the shroud 14. The outlets 20 are used for the removal of the overspray stream 12 from within the shroud 14 and are connected to the manifolds 16. The hose/ducting 17 leads from the manifolds 16 to a filtration device (not shown) for transferring the overspray stream 12 to be treated. A suction force is applied to the hose/ducting 17 by the suction device 11 to pull the overspray stream 12 from the shroud 14 via the outlets 20 and manifolds 16. Adjustable dampers 30 shown in FIGS. 1–2 allow control of the amount of air 40 passing through the slots 22 into the shroud 14. As shown in FIGS. 1–2, the slots 22 and dampers 30 can be replaced by a screen 42 having holes 44, as shown in FIGS. 3–5. Whereby, the size of the holes 44 corresponds to the required amount of air 40 needed inside the shroud 14 to properly regulate the internal flow within the shroud 14. FIGS. 3–5 show the internal baffles 24 removed for clarity. The structural support frame 32 provides a hard connection point for the overspray collector 10. FIG. 1 shows the actuating arm 18 connected to the structural support frame 32. The actuating arm 18 allows for a uniform motion of the overspray collector 10 over the work surface 38. In contrast to spray-booth-type overspray systems, the overspray collector 10 moves with the spraying device 36 and allows the spray painting of large flat surfaces by way of the manually- or robotically-controlled traversing arm 18.

Figure 6:
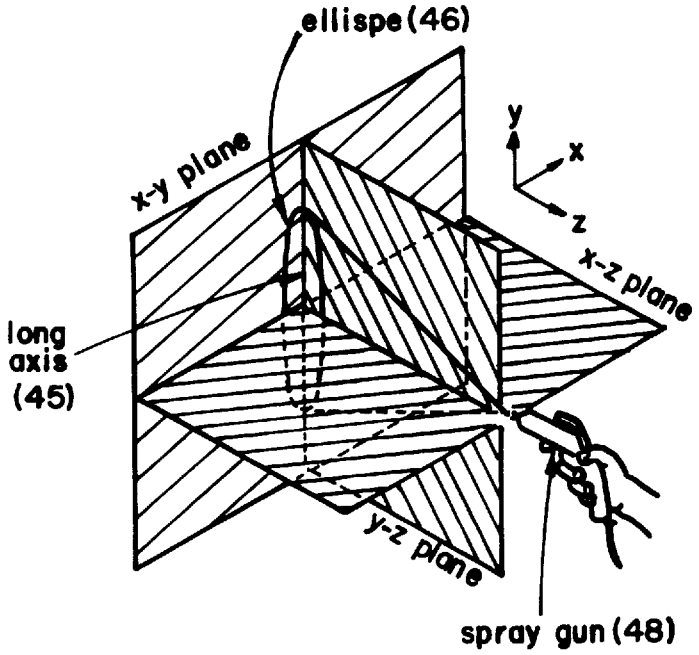
FIG. 6 is a schematic of a coordinate frame of reference for application of a coating to a work surface.
Figure 7:
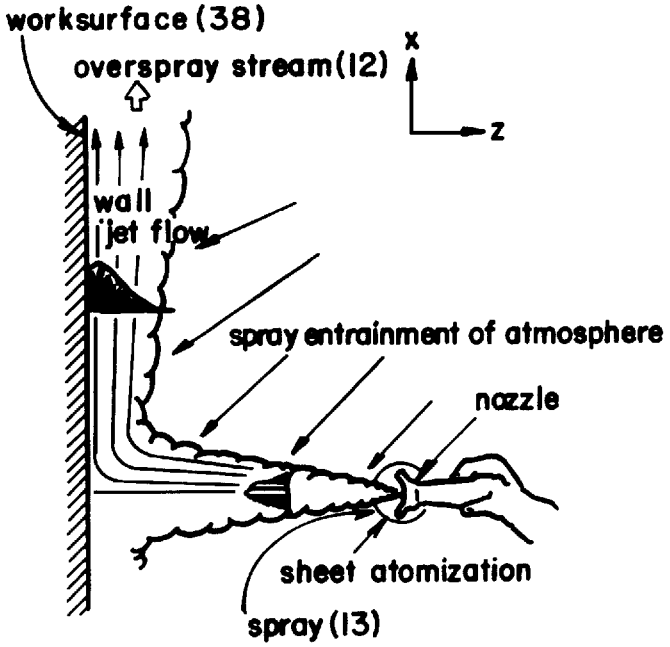
FIG. 7 is a schematic of a flow from a spray device in the x-z plane as referenced in FIG. 6.

The principle behind the operation of the overspray collector 10 is now described. As stated in the background, the spray from a spray gun is generally shaped in the form of an elongated spray ellipse or "fan" to provide the application of a uniform coating. FIG. 6 shows a coordinate system for referencing a spray ellipse 46 from a spray gun 48, where the long axis 45 of the spray ellipse 46 lies in the y-z plane that passes through the orifice of the spraygun 48. Since the flowfield of the spray 13 displays two-dimensional symmetry about the y-z plane, a diagram of its streamlines in the perpendicular x-z plane is sufficient to describe the entire flowfield, as shown in FIG. 7. Following sheet-type atomization at the spray nozzle, a dense spray 13 of exaggerated elliptical cross-section proceeds rapidly toward the work surface 38. The spray 13 strongly entrains the surrounding atmosphere due to the combined effect of mixing in the aerodynamic wakes of spray droplets. A significant co-flowing airstream of spray 13 and air from the atmosphere is thus formed, whether the spray type is the airspray, airless, or hybrid.

Upon reaching the work surface 38, the co-flowing airstream of FIG. 7 impinges upon the work surface 38. While the co-flowing airstream must abruptly turn parallel to the work surface 38 along the ±x-directions shown in FIGS. 6–7, the largest paint droplets have sufficient inertia to cross the indicated mean aerodynamic streamlines and strike the work surface 38. However, the finer paint droplets follow the streamlines and turn parallel to the work surface 38, therefore never impinging upon the work surface 38. Thus, the impingement of the co-flowing airstream upon the work surface 38 separates the paint particle distribution into a large-particle fraction which strikes the work surface 38 and a small-particle fraction which does not reach the work surface 38. The small-particle fraction becomes the overspray stream 12, which includes the air from the entrained atmosphere. The almost-two-dimensional outflow of the overspray stream 12 in the ±x-directions along the work surface 38 is commonly known as a wall jet flow. The overspray stream 12 eventually separates from the work surface 38 at some undetermined distance from the co-flowing airstream impingement location, thus spreading the overspray into the surrounding atmosphere.

Figure 8:
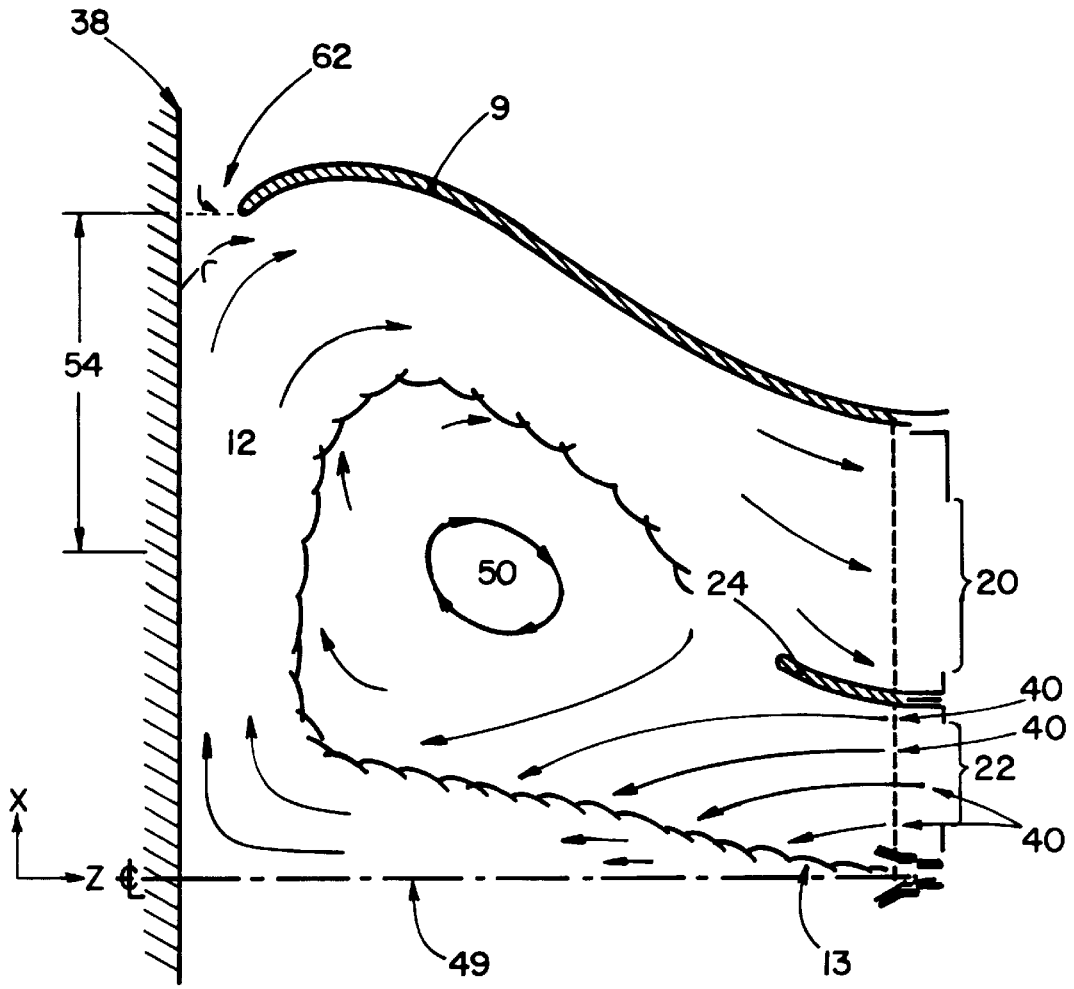
FIG. 8 is a cross-sectional view of a shroud with a flowfield according to the present invention.

FIG. 8 shows the flowfield of FIG. 7 enclosed within the shroud 14. The orientation of FIG. 8 is the same as that of FIG. 7, namely, that of the x-z plane shown in FIG. 6, which is also the natural coordinate frame for the planar two-dimensional spray painting flowfield. Only the right half-plane or +x-direction is shown in FIG. 8, since the flow within the shroud 14 is symmetric about the indicated centerline 49 (the z-axis). Further, the simplification of assuming a two-dimensional flow means that changes in the flowfield shown in FIG. 8 are expected to be small in the direction perpendicular to the plane of FIG. 8.

The overspray collector 10 functions by the generation of an approximately-two-dimensional flowfield dominated by twin columnar vortices 50 (only one shown in FIG. 8) and by the separation of the overspray stream 12 from the work surface 38. The vortices 50 are oriented with their axes parallel to both the work surface 38 and the y-axis. Separation of the overspray stream 12 is by way of an imposed adverse pressure gradient acting along a downstream segment 54 of the work surface 38, as shown in FIG. 8. The task of the overspray collector 10 is to manage the flow shown in FIG. 7, such that the overspray stream 12 is forced to separate almost immediately from the work surface 38. The overspray stream 12 of overspray-laden air is collected efficiently by the shroud 14 and suctioned away using the manifolds 16, hose/ducting 17 and the suction device 11. Thus, the overspray stream 12 is captured near its source to avoid the release of any significant quantity of overspray into the atmosphere.

Figure 9:
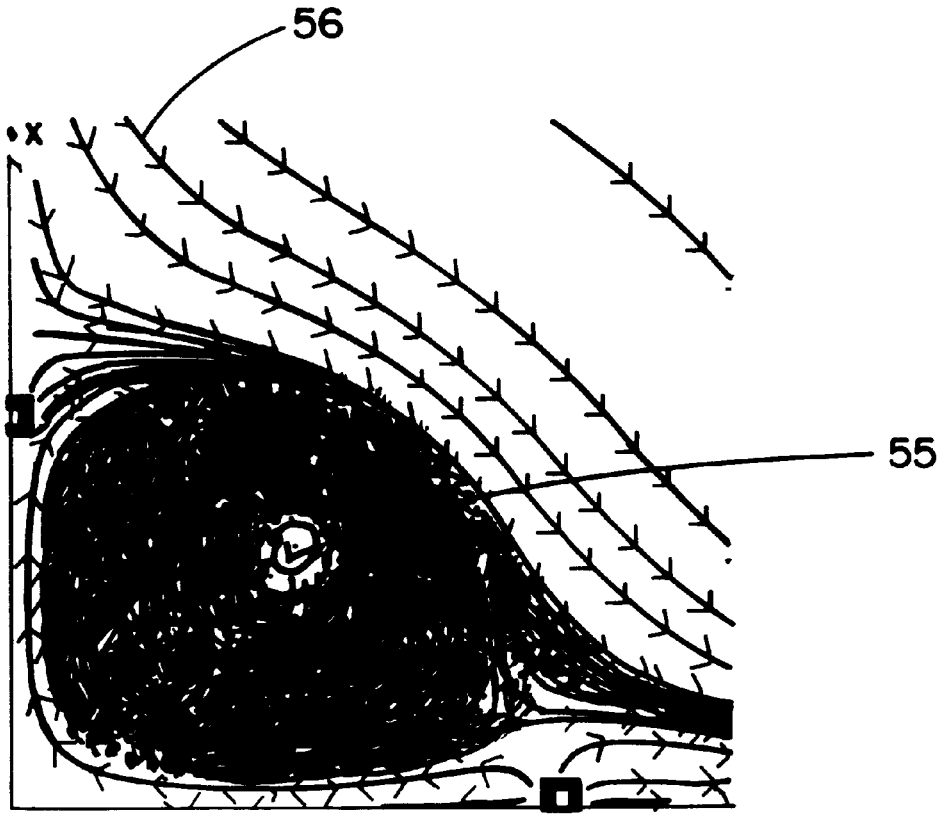
FIG. 9 is a graph of a flowfield according to present invention.

The optimum shape for the shroud 14, in particular its sides 9, to capture the overspray stream 12 as shown in FIG. 8, was first determined by generating an approximate flowfield, as shown in FIG. 9. To generate the flowfield of FIG. 9, the potential-flow assumption was made with a reflection plane representing the work surface 38, sources used to generate and "separate" an overspray-laden flow, a sink to collect it, and a vortex singularity to induce the required circulation. As shown in FIG. 9, the streamline results provide a compelling image of a flowfield dominated by a strong vortical flow, having a core at 55. Moreover, a streamline near the boundary of the vortical region 56 suggested a bell-shaped contour for sides 9 of the shroud 14 to contain the overspray stream 12 and force an appropriate pressure distribution to separate the overspray stream 12 from work surface 38. Next, a more elaborate 2-D computation was carried out to solve the governing Navier-Stokes equations, with appropriate boundary conditions extracted from the flow observations described above. An acceptable level of approximation was obtained by ignoring the particulate phase altogether, but realistically specifying the entrained airflow which results therefrom, which confirmed that the bell-shaped contour was an acceptable shape for the sides 9 of the shroud 14.

The overall dimensions of the shroud 14 are determined by the distance of the spray device 36 from the work surface 38 and length of the long axis 45 of the spray ellipse 46. The normal distance of the spray device 36 from the work surface 38 is usually about twelve (12) inches. The total width of the shroud 14 from the left shroud side 9 to the right shroud side 9 along the ±x-directions is approximatly double the distance of the spray device 36 from the work surface 38. The height of the shroud 14 is subject to the length of the long axis 45 of the spray ellipse 46 and must be at least equal that length. If there is more than one spray device 36, the shroud height would be approximately the combined length of all the long axes 45 of spray ellipses 46 from each spray device 36. Since the flowfield within the shroud 14 is approximately two-dimensional in the x-z plane, the shroud 14 is simply terminated at top and bottom by end caps 26 as shown in FIGS. 1, and 3–5.

During movement of the overspray collector 10 along the work surface 38 for coating operations, a small gap 62 must be maintained between the shroud 14 and the work surface 38. The gap 62 avoids marring the newly applied coating and provides a slight air inflow to prevent the overspray stream 12 from escaping the interior of the shroud 14. The gap 62 is usually on the order of zero (0) to six (6) inches from the work surface 38 for normal spray distances between the spray device 36 and the work surface 38. Sensors and other automated equipment (not shown) can be employed to maintain the proper distance from the work surface 38 for the gap 62.

The air inlet slots 22 with dampers 30 or the screen 42 with holes 44 allow control of the amount of air 40 entering the shroud 14 to be entrained by the spray 13 within the shroud 14. The dampers 30 allow the amount of air 40 flowing into the shroud 14 to be reduced to zero. The slots 22 or holes 44 also allow control of the internal pressure of the shroud 14. Internal to the shroud 14, the spray 13 from the spray device 36 entrains air of the internal atmosphere of the shroud 14 due to the drag of spray particles or droplets. This entrainment of the internal atmosphere of the shroud 14 induces an effective suction which draws in air 40 through the inlets slots 22 or holes 44. The air 40 allowed to enter the shroud 14 is used to approximately balance the outflow of the overspray stream 12 though the outlets 20 and thus minimize residual airflow through the gap 62. The internal baffles 24 (not shown in FIGS. 3–5) isolate the outlets 20 from the air 40 entering the shroud 14 through the slots 22 or holes 44. The co-flowing stream of spray 13 and entrained atmosphere then impinges upon the work surface 38, whereupon the finer particles turn laterally along the work surface 38 without being deposited, thus forming the lateral overspray stream 12. Next, the lateral overspray stream 12, in the form of the wall jet flow, is intercepted by the shroud 14, in particular by sides 9. During interception by the shroud 14, the overspray stream 12 is forced to separate from the work surface 38 just before gap 62 due to the imposed adverse pressure gradient over the length 54. Then, the overspray stream 12 is induced through the outlets 20 by the suction device via the manifolds 16 and hose/ducting 17. The inside surface of the sides 9 are used to direct the overspray stream 12 to the outlets 20 during inducement by the suction device. The manifolds 16 and hose/ducting 17 attached to outlets 20 allow removal of the overspray stream 12 by the suction device to a location where the overspray stream 12 can be filtered or otherwise treated to remove coating particles from the overspray stream 12 using any known means of air filtration. The inlet air rate should be controlled in order to allow some air to enter via the gap 62. The air entering the gap 62 prevents any of the overspray stream from escaping from the gap 62, thereby making the overspray collector 10 one-hundred percent (100%) efficient at capturing overspray.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appendd claims and any and all equivalents thereof.

I claim:

1. An overspray collector for collecting overspray during spraying of a work surface comprising:

a shroud having an open front, two sides, two end caps and a back, said open front for placement near said work surface to be sprayed;

at least one spray device enclosed by said shroud, said at least one spray device positioned to spray out from said open front and onto said work surface;

at least one overspray removal outlet for removing said overspray; and at least one air slot positioned behind at least one said spray device in said shroud for allowing inlet air to enter said shroud, be directed at said work surface and to balance the removal of air associated with the removal of said overspray, and wherein said spray device is configured to produce an airflow internal to said shroud to entrain said inlet air to produce a co-flowing stream directed towards said work surface.

2. The overspray collector of claim 1, wherein said spray devices are connected to said back of the shroud.

3. The overspray collector of claim 1, wherein said shroud further includes at least one baffle between said air inlet slots and said overspray removal outlets, for separation of said inlet air from said overspray being removed.

4. The overspray collector of claim 1, further including a suction device and ducting leading from said overspray removal outlets to said suction device for inducing said overspray stream from said shroud.

5. The overspray collector of claim 4, further including a manifold between said outlets and said ducting.

6. The overspray collector of claim 1, further including at least one damper for adjusting the size of said slots and controlling flow amount of inlet air into said shroud.

7. The overspray collector of claim 1, wherein said air inlet slots are holes of a screen and wherein said holes are sized to allow a controlled amount of inlet air into said shroud.

8. The overspray collector of claim 1, wherein said sides have a bell-shaped contour.

9. The overspray collector of claim 1, wherein said shroud includes a support frame for mounting said collector.

10. The overspray collector of claim 1, wherein said collector includes at least two spray devices which each provide a coating of a spray ellipse on a surface to be coated and wherein said spray devices are mounted inline with each other along a long axis of said spray ellipses.

11. The overspray collector of claim 1, wherein said shroud has a width between said sides of at least twice the spraying distance of said spray devices from a surface to be coated.

12. The overspray collector of claim 1, wherein said shroud has a height between said end caps of at least that of a long axis of a spray ellipse formed on a surface to be coated by a coating from said spray devices.

13. A method of collecting overspray comprising:

a. spraying a coating of spray onto a work surface from at least one spray device mounted within a shroud, said shroud having an open front, two sides, two end caps, a back, and an overspray removal outlet, said open front for placement near said work surface;

b. allowing inlet air to enter said shroud through an inlet air slot in said back of said shroud, wherein said inlet air is directed at said work surface, and wherein said inlet air entering said shroud approximately balances the removal of air associated with the removal of said overspray;

c. entraining into said spray an atmosphere internal to said shroud to produce a co-flowing stream of inlet air and spray directed towards said work surface;

d. allowing said co-flowing stream to impinge on said work surface, wherein larger particles of said spray are applied to said work surface and finer particles of said spray remain with said co-flowing stream to form an overspray stream which turns and flows laterally along said work surface;

e. intercepting said overspray stream with said shroud to force said overspray stream to separate from said work surface due to an imposed adverse pressure gradient;

f. directing the intercepted overspray stream to at least one outlet of said shroud for removal of said overspray stream from said shroud; and g. applying a suction force to said outlets to induce said overspray stream through said outlets and out of said shroud.

14. The method of claim 13, wherein said outlets are connected to ducting for transferring said overspray stream.

15. The method of claim 13, wherein a gap is maintained between said shroud and work surface.

16. The method of claim 15, wherein said gap is between zero (0) and six (6) inches.

17. The method of claim 13, wherein said shroud includes at least one air inlet slot to allow said inlet air to enter said shroud.

18. The method of claim 17, wherein said shroud includes at least one damper to control the amount of said inlet air entering said shroud.

19. The method of claim 13, wherein said shroud includes a screen with holes sized to allow a controlled amount of said inlet air into said shroud.

20. The method of claim 13, wherein said shroud includes at least one internal baffle to separate said inlet air from said outflow of said overspray.

21. The method of claim 13, wherein said shroud has a bell-shape contour for intercepting and directing said overspray stream.

22. The method of claim 13, wherein said shroud has a width between said sides of at least twice the spraying distance of said spray devices from said work surface.

23. The method of claim 13, wherein said shroud has a height between said end caps of at least that of a long axis of a spray ellipse formed on said work surface by said spray from said spray devices.

24. The method of claim 13, wherein said shroud moves along said work surface during spraying of said work surface.

25. The method of claim 13, wherein an approximately-two-dimensional flowfield is generated during interception of said overspray stream which is dominated by twin columnar vortices which are oriented with their axes parallel to said work surface.

* * * * *